US008485124B2

(12) United States Patent
Kim et al.

(10) Patent No.: US 8,485,124 B2
(45) Date of Patent: Jul. 16, 2013

(54) SILVER THIN-FILM SPREAD APPARATUS BY MEANS OF DEPOSITION OF NANO METALLIC SILVER

(75) Inventors: Shi Surk Kim, Chungcheongnam-do (KR); Seong Uk Lee, Chungcheongnam-do (KR); Si Doo Kim, Gyeonggi-do (KR)

(73) Assignee: NANO CMS Co., Ltd. (KR)

( * ) Notice: Subject to any disclaimer, the term of this patent is extended or adjusted under 35 U.S.C. 154(b) by 277 days.

(21) Appl. No.: 12/956,799

(22) Filed: Nov. 30, 2010

(65) Prior Publication Data

US 2012/0085280 A1 Apr. 12, 2012

(30) Foreign Application Priority Data

Oct. 12, 2010 (KR) ..... 10-2010-0099201

(51) Int. Cl.

| | |
|---|---|
| ***B05B 13/04*** | (2006.01) |
| ***B05B 1/28*** | (2006.01) |
| ***B05B 7/06*** | (2006.01) |
| ***B05C 5/00*** | (2006.01) |
| ***B05C 11/02*** | (2006.01) |

(52) U.S. Cl.

USPC ..... 118/321; 118/326; 118/313; 118/315; 118/320; 118/323; 118/52; 118/612

(58) Field of Classification Search

USPC ..... 118/319, 320, 326, 313–315, 50, 118/52, 612, 321, 323; 396/604, 611, 627; 427/240

See application file for complete search history.

(56) References Cited

U.S. PATENT DOCUMENTS

| | | | | |
|---|---|---|---|---|
| 5,720,814 | A * | 2/1998 | Takagi et al. | 118/319 |
| 6,589,339 | B2 * | 7/2003 | Takeshita et al. | 118/50 |
| 6,672,779 | B2 * | 1/2004 | Ueda et al. | 396/604 |
| 2003/0039766 | A1 * | 2/2003 | Barnes et al. | 427/569 |

* cited by examiner

*Primary Examiner* — Yewebdar Tadesse
(74) *Attorney, Agent, or Firm* — Rodman & Rodman

(57) ABSTRACT

Disclosed is a silver thin film spread apparatus by means of deposition of nano metallic silver, the apparatus comprising: a treatment booth formed at one side with an inlet for inputting a substrate, and formed at the other side with an outlet for discharging the substrate; a transfer device formed at a lower side of the treatment booth for transferring the substrate; a spray device formed at an upper side of the treatment booth for spraying silver solution on a surface of the substrate; a moving device for linearly reciprocating the spray device; and a rotation device formed at the lower side of the treatment booth for rotating the substrate, whereby reflectivity can be enhanced by increasing film compactness and coating uniformity of thin film, where the substrate is rotated at a predetermined constant speed to allow the spray guns to linearly reciprocate and to allow the nano silver thin film to be uniformly spread and deposited on the surface of the substrate at a predetermined constant frequency.

11 Claims, 6 Drawing Sheets

SILVER THIN-FILM SPREAD APPARATUS BY MEANS OF DEPOSITION OF NANO METALLIC SILVER

This application claims priority from Korean Patent Application No. 10-2010-0099201 filed on Oct. 12, 2010 in the Korean Intellectual Property Office (KIPO), the disclosure of which is incorporated herein by reference in its entirety.

BACKGROUND OF THE DISCLOSURE

1. Field

The present disclosure relates to a silver thin-film spread apparatus by means of deposition of nano metallic silver configured to form nano metallic silver thin-film on a surface of a substrate.

2. Background

Generally, surfaces of resin molded articles such as vehicle parts and electric home appliances parts are widely used with wet plating or dry vacuum deposition devices to provide a luxurious and beautiful metallic appearance. In order to provide these resin molded articles with a luxurious and beautiful metallic appearance, plating with copper, nickel, and the like is applied on the plastic resin molded articles using plating and/or vacuum deposition methods. However, the coating method involving the conventional plating process raises_problems in wastewater treatment on environment, which in turn creates disadvantages of increasing wastewater treatment facilities that need strict control thereon.

Consequently, increased investment in wastewater treatment facilities and increased size of the facilities for the vacuum deposition devices decrease the productivity. Furthermore, mirrors or reflection plates are generally made continuously by a sequence of steps on a mirror conveyor. The conventional methods for manufacturing reflection plates are constructed such that mixed solution for forming a silver film by means of the prior art plating method is sprayed on and combined at the sensitized glass surface to deposit the silver film.

However, if the conventional reflection plate manufacturing method is employed, the deposition uniformity of the silver film layer is disadvantageously low to decrease the reflectivity to allow light to escape, whereby it is difficult to form a predetermined thickness of silver film and to reduce the manufacturing cost.

Particularly, there is an omnipresent need of manufacturing a reflection plate with a high reflectivity and price competitiveness over that of the conventional reflection plate in generation of electricity using solar light.

SUMMARY OF THE DISCLOSURE

Therefore, the present disclosure has been made in view of the above problems, and the present disclosure is to provide a silver thin-film spread apparatus by means of deposition of nano metallic silver configured to enhance reflectivity by increasing film compactness and coating uniformity of thin film.

Furthermore, the present disclosure is to provide a silver thin-film spread apparatus by means of deposition of nano metallic silver configured to form nano metallic silver-deposited uniform thin silver film on a surface of a substrate.

Still furthermore, the present disclosure is to provide a silver thin-film spread apparatus by means of deposition of nano metallic silver configured to form uniform nano silver thin film on a surface of a substrate regardless of shape of the substrate.

Still furthermore, the present disclosure is to provide a silver thin-film spread apparatus by means of deposition of nano metallic silver configured to maximize energy production capacity in concentrated solar power (CSP) systems, concentrator photo-voltaics (CPV) and solar light generating systems by minimizing loss of light energy generated in reflection of solar light in manufacturing a solar heat reflection plate, and by maximizing the reflectivity of the solar light.

Still furthermore, the present disclosure is to provide a silver thin-film spread apparatus by means of deposition of nano metallic silver configured to mass-produce nano silver thin films by automating the formation of nano silver thin films.

As a result of study on nano silver thin film by the present applicants, a Korean Patent No. 10-2009-0091500 to Kim, Shi-Surk et. al was filed for patent registration after verifying the formation of nano silver thin film by way of electroless deposition of nano metallic silver in which colloidal silver which comprises ionic silver, and reduction solution which comprises a reduction agent for colloidal silver are prepared, and the prepared colloidal silver and the reduction solution are sprayed to a certain space separated from a substrate.

Technical subjects to be solved by the present disclosure are not restricted to the above-mentioned description, and any other technical problems not mentioned so far will be clearly appreciated from the following description by the skilled in the art.

In one general aspect of the present disclosure, there is provided a silver thin film spread apparatus by means of deposition of nano metallic silver, the apparatus comprising: a treatment booth formed at one side with an inlet for inputting a substrate, and formed at the other side with an outlet for discharging the substrate; a transfer device formed at a lower side of the treatment booth for transferring the substrate; a spray device formed at an upper side of the treatment booth for spraying silver solution on a surface of the substrate; a moving device for linearly reciprocating the spray device; and a rotation device formed at the lower side of the treatment booth for rotating the substrate.

In some exemplary embodiments of the present disclosure, a first door for air-tightly opening and closing the inlet may be formed at the inlet of the treatment booth, and a second door air-tightly opening and closing the outlet may be formed at the outlet of the treatment booth.

In some exemplary embodiments of the present disclosure, the apparatus may further include a thermo-hygrostat and an air discharge device formed at the treatment booth for maintaining an interior of the treatment booth at a constant temperature state and at a constant humidity state.

In some exemplary embodiments of the present disclosure, the spray device may include a plurality of spray guns formed on an upper side of the treatment booth, each distanced apart at a predetermined space, a support horizontally formed on the upper side of the treatment booth, an adjusting rod connected at the support at a predetermined space, and mounted at a distal end with the spay gun, and a height adjustor formed between the support and the adjusting rod for adjusting a height of the spray gun.

In some exemplary embodiments of the present disclosure, the spray gun may be applied with a two-headed spray gun having two nozzles, and the nozzle may have a diameter in the range of 0.5 mm~1 mm.

In some exemplary embodiments of the present disclosure, the moving device may include a housing fixed at an upper surface of the treatment booth, a lead screw rotatably supported at both sides of the housing, a motor connected to a distal end of the lead screw to rotate the lead screw, and a moving rail screwed to the lead screw and fixed to the support.

In some exemplary embodiments of the present disclosure, the rotation device may include a suction plate formed at a lower side of the treatment booth for vacuum-sucking a substrate transferred into the treatment booth by the transfer device, a lift unit formed at a lower side of the suction plate for horizontally moving the suction plate such that the substrate can be separated from a transfer roller, and a rotation unit for rotating the suction plate.

In some exemplary embodiments of the present disclosure, the lift unit may include a driving cylinder fixed at a frame, a support plate fixed at an operation rod of the driving cylinder, and a connection member for connecting the support plate and the suction plate.

In some exemplary embodiments of the present disclosure, the rotation unit may include a driving motor fixed at the support plate, a driving gear fixed at a driving axis of the driving motor, and a driven gear meshed with the driving gear and fixed at a periphery of the connection member fixed at a lower surface of the suction plate.

In some exemplary embodiments of the present disclosure, the apparatus may further include an air/solution supply device for supplying high pressure air and silver solution to the spray gun.

In some exemplary embodiments of the present disclosure, the air/solution supply device may include an air tank for storing high pressure air, a heating unit connected to the air tank for heating the high pressure air discharged from the air tank to high pressure high temperature air, a solution storage tank connected to the heating unit for supplying the high pressure high temperature air, for storing the solution, heating, by the high pressure high temperature air, the silver solution to a predetermined temperature, and pumping the silver solution, a plurality of spray guns for being supplied with the solution stored in the solution storage tank and with the high pressure high temperature air that has passed the heating unit, and spraying the solution to the surface of the substrate, and a control box connected to the heating unit and to the plurality of spray guns for individually controlling pressure of air supplied to the plurality of spray guns.

In some exemplary embodiments of the present disclosure, the solution storage tank may include a tank body for storing the solution and a sealing cover air-tightly mounted at an upper surface of the tank body that is opened, wherein the sealing cover may include an air inlet pipe connected to the heating unit for supplying the high pressure high temperature air into the tank body, and a solution supply pipe individually connected to the plurality of spray guns via a solution line for supplying an equal amount of solution to the plurality of spray guns.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
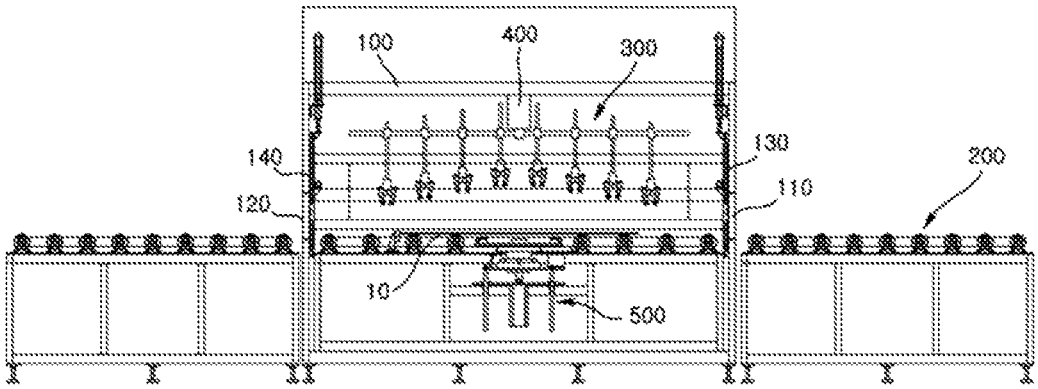
FIG. 1 is a schematic view illustrating a silver thin film spread apparatus according to an exemplary embodiment of the present disclosure.

Hereinafter, exemplary embodiments of the present disclosure are described in detail with reference to the accompanying drawings. In the drawings, sizes or shapes of constituent elements may be exaggerated for clarity and convenience.

Particular terms may be defined to describe the disclosure in the best mode as known by the inventors. Accordingly, the meaning of specific terms or words used in the specification and the claims should not be limited to the literal or commonly employed sense, but should be construed in accordance with the spirit and scope of the disclosure. The definitions of these terms therefore may be determined based on the contents throughout the specification. Acronyms are used extensively throughout the description to avoid excessively long descriptive phrases. The meaning will be clear from the context of the description.

FIG. 1 is a schematic view illustrating a silver thin film spread apparatus according to an exemplary embodiment of the present disclosure.

Referring to FIG. 1, the silver thin film spread apparatus by means of deposition of nano metallic silver according to an exemplary embodiment of the present disclosure may include a treatment booth (100) formed at one side with an inlet (110) for inputting a substrate (10), and formed at the other side with an outlet (120) for discharging the substrate (10); a transfer device (200) formed at a lower side of the treatment booth (100) for automatically transferring the substrate (10); a spray device (300) formed at an upper side of the treatment booth (100) for spraying silver solution on a surface of the substrate (10); a moving device (400) for linearly reciprocating the spray device (300); and a rotation device (500) formed at the lower side of the treatment booth (100) for rotating the substrate (10) inserted into the treatment booth (100).

The treatment booth (100) may take an air-tightly sealing shape for preventing the silver solution sprayed from the spray device (300) from being discharged to outside, where the inlet (110) includes a first door (130) for air-tightly opening and closing the inlet (110) and a second door (140) for air-tightly opening and closing the outlet (120).

The treatment booth (100) may include a thermo-hygrostat (not shown) for maintaining an interior of the treatment booth (100) at a constant temperature state and at a constant humidity state, such that the silver solution can be evenly deposited on the surface of the substrate (10).

Unless the temperature and humidity inside the treatment booth (100) are maintained at a constant level, thickness of nano silver thin film deposited on the surface of the substrate cannot be uniformly formed or film compactness can be reduced, such that the thermo-hygrostat is used to maintain the temperature and humidity inside the treatment booth (100) at a constant level.

Figure 2:
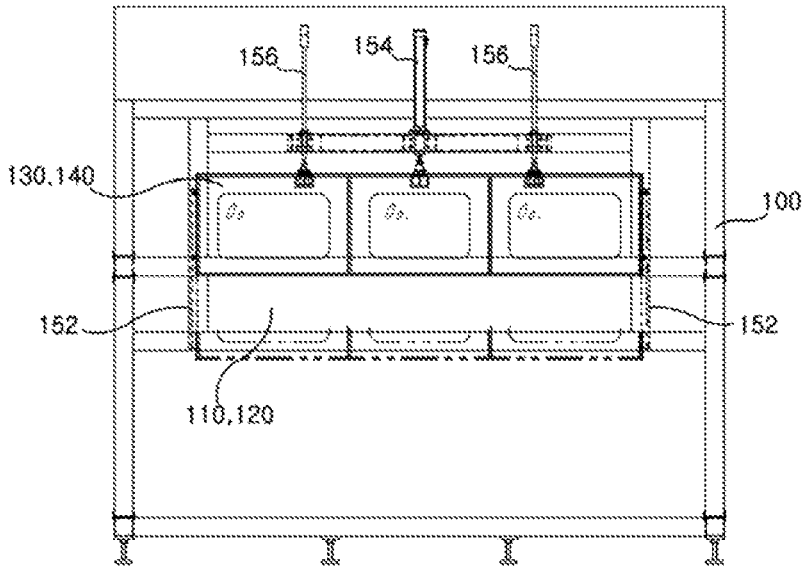
FIG. 2 is a lateral view illustrating a door according to an exemplary embodiment of the present disclosure.

Referring to FIG. 2, the first and second doors (130, 140) are vertically movably arranged by being inserted into a guide rail (152) formed at both lateral surfaces of the inlet (110) and outlet (120), and are connected thereon to a driving device (154) to open or close the doors (130, 140). Furthermore, at least one or more guide rods (156) are provided to linearly move the doors (130, 140).

Aside from the above-mentioned structure, the first/second doors (130, 140) may take any opening/closing structures as long as the inlet (110) and the outlet (120) can be air-tightly opened or closed.

Figure 3:
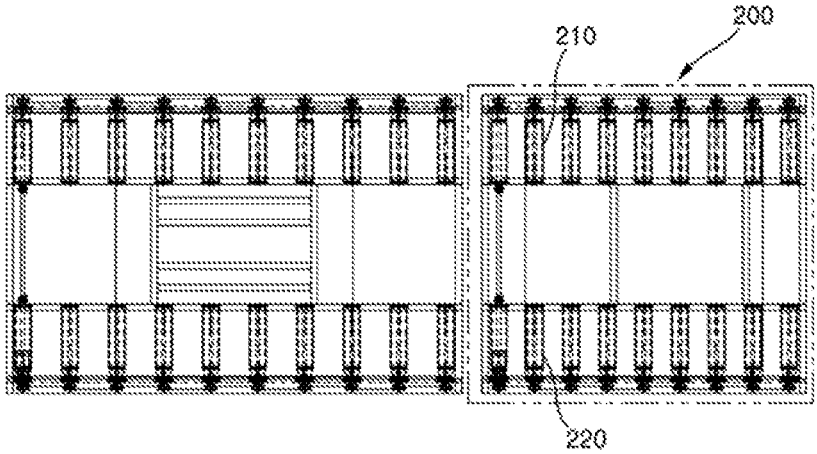
FIG. 3 is a plan view illustrating a transfer device according to an exemplary embodiment of the present disclosure.

The transfer device (200) may take the shape of a roller conveyor type, where, in a case a plurality of transfer rollers (210,220) is rotatably driven, the substrate on the transfer rollers linearly move, and the plurality of transfer rollers (210, 220) is connected to the driving motor to be rotatably driven, as shown in FIG. 3.

The transfer rollers (210, 220) include the first transfer roller (210) formed at a predetermined space at a left hand side of a direction in which the substrate is transferred, and the second transfer roller (220) formed at a predetermined space at a right hand side of a direction in which the substrate is transferred. A predetermined space is formed between the first and second transfer rollers (210, 220, such that in a case the substrate (10) is transferred into the treatment booth (100), the rotation device (400) can be sucked on to a lower surface of the substrate (10).

As noted above, the silver thin film spread apparatus by means of deposition of nano metallic silver according to an exemplary embodiment of the present disclosure may be constructed in such way that operation is performed inside the treatment booth (100), and the first and second doors (130, 140) are air-tightly mounted at the inlet (110) and the outlet (120) of the treatment booth (100), whereby nano-sized metallic silver particles sprayed into the treatment booth (100) can be prevented from being discharged to outside, and as a result, atmospheric environment pollution can be also prevented to allow an interior of a work place to be maintained in a clean state.

Figure 4:
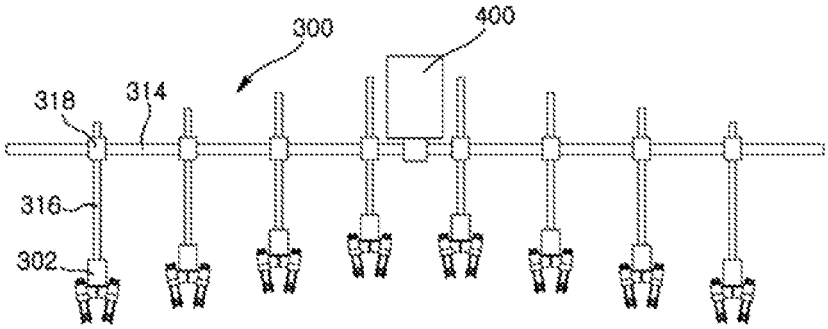
FIG. 4 is a lateral view illustrating a spray device according to an exemplary embodiment of the present disclosure.
Figure 5:
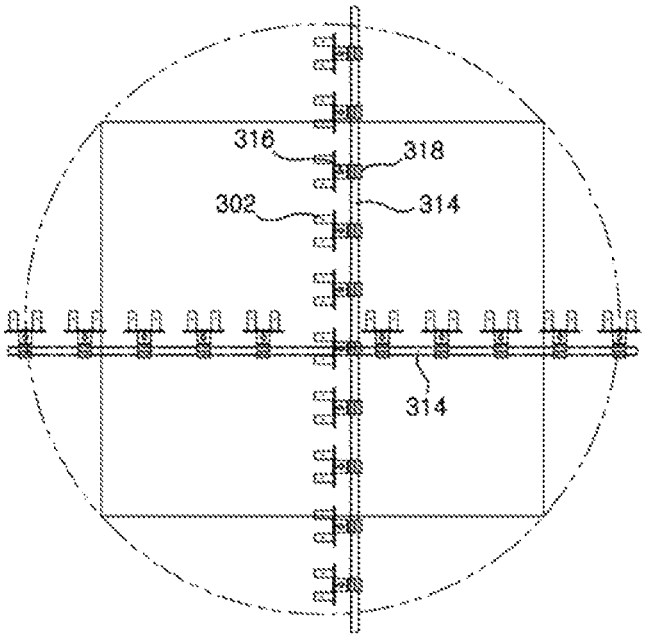
FIG. 5 is an upper view illustrating a spray device according to an exemplary embodiment of the present disclosure.

Referring to FIGS. 4 and 5, the spray device (300) may include a support bar (314) formed at an upper side of the treatment booth (100) in a cross shape, and an adjusting rod (316) length-adjustably and plurally formed on the support bar (314) each distanced at a predetermined space, and formed with a spray gun (302) for adjusting height of the spray gun (302).

The support bar (314) may take various shapes including a straight line and a radial type in addition to the cross depending on size and shape of the substrate. A height adjustor (318) may be formed at a connection area between the adjusting rod (316) and the support bar (314) to adjust the length of the adjusting rod (316) and to adjust a distance between the spray gun (302) and the substrate (10).

The height adjustor (318) may be fixed by a clamp, and may be applied with a method in which the clamp is unfastened to adjust the length of the adjusting rod (316) and to fasten the clamp again. The height adjustor (318) may be also applied with a method in which an actuator is mounted at each adjusting rod (316) to automatically adjust the length of the adjusting rod (316), or a method in which a permanent magnet is used to fix a position of a length-adjusted adjusting rod (316).

As noted above, the plurality of spray guns (302) may be individually adjusted in height thereof.

Figure 6:
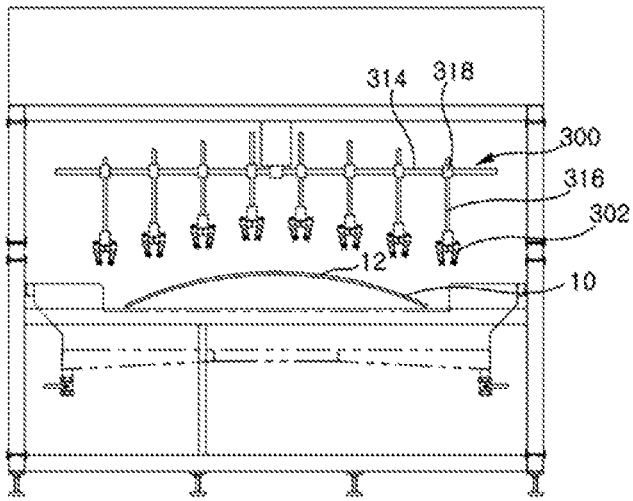
FIG. 6 is a lateral view illustrating a spray device according to another exemplary embodiment of the present disclosure.

For example, in a case a substrate (12) is shaped of a dome as shown in FIG. 6, each length of adjusting rods (316) may be individually adjusted to allow the length of each spray gun (302) to be equal to that of dome-shaped substrate (12).

Figure 7:
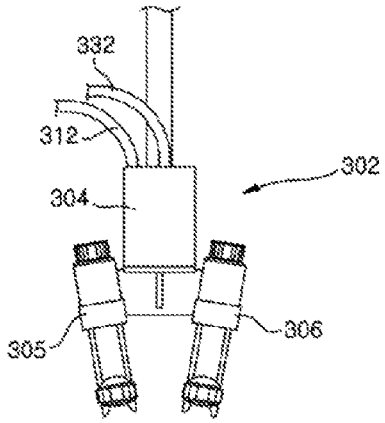
FIG. 7 is a plan view illustrating a spray gun according to an exemplary embodiment of the present disclosure.

Referring to FIG. 7, the spray gun (302) may include a solution line (312) for introducing the silver solution, a main body (304) connected to an air line (332) for introducing high pressure high temperature air, and two nozzles (305, 306) each mounted at a distal end of the main body (304) at a predetermined angle. The automatically spraying spray gun (302) may have two nozzles each nozzle having a diameter in the range of 0.5 mm~1 mm. The spray gun (302) has two nozzles each arranged at a predetermined angle, such that the silver solution sprayed from the two spray guns may meet and be hit at a predetermined area to be sprayed in nano particles.

The spray gun (302) may be so structured as to manually adjust the angles of two nozzles (305, 306), or to fix the angles of the two nozzles. The apparatus may further include an air/solution supply device for supplying high pressure air and silver solution to the spray gun (302).

Figure 8:
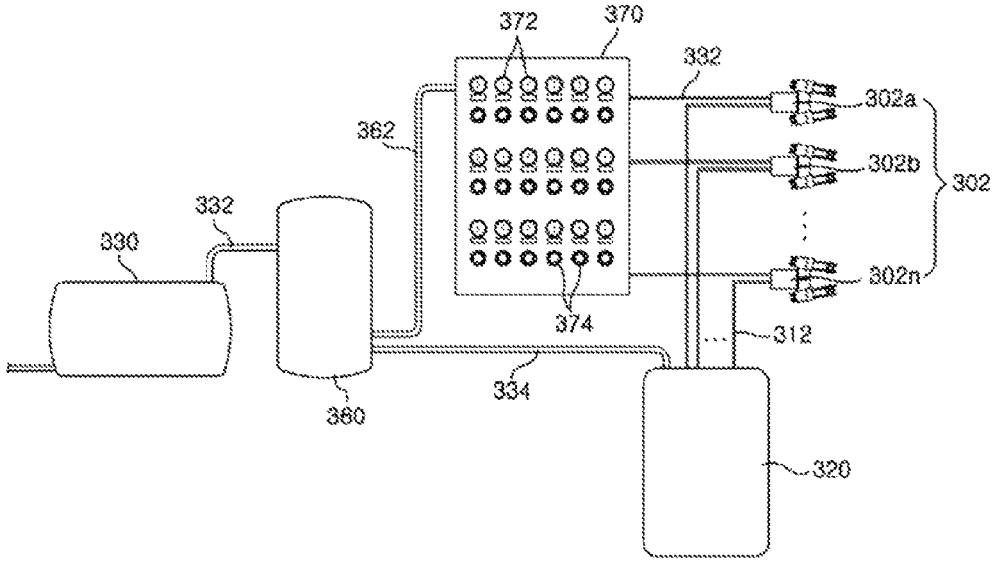
FIG. 8 is a schematic view illustrating an air/solution supply device according to an exemplary embodiment of the present disclosure.

Referring to FIG. 8, the air/solution supply device may include an air tank (330) for storing high pressure air, a heating unit (360) connected to the air tank for heating the high pressure air discharged from the air tank to high pressure high temperature air, a solution storage tank (320) connected to the heating unit (360) for supplying the high pressure high temperature air, for storing the solution, heating, by the high pressure high temperature air, the silver solution to a predetermined temperature, and pumping the silver solution, and a control box (370) connected to the heating unit and to the plurality of spray guns for individually controlling pressure of air supplied to the plurality of spray guns.

The air tank (330) is a tank for filling the high pressure air generated by a compressor that is separately mounted, and is connected to the heating unit (360) via an air line (332) to supply the high pressure air to the heating unit (360).

The heating unit (360), provided to heat the air stored in the air tank (360) to a high temperature, is mounted therein with a heater and a pipe in which the air passes, such that the heater heats the air passing through the pipe, supply the heated air to the control box (370) via an air line (362) and supply the heated air to the solution storage tank (320) via an air line (334).

Figure 9:
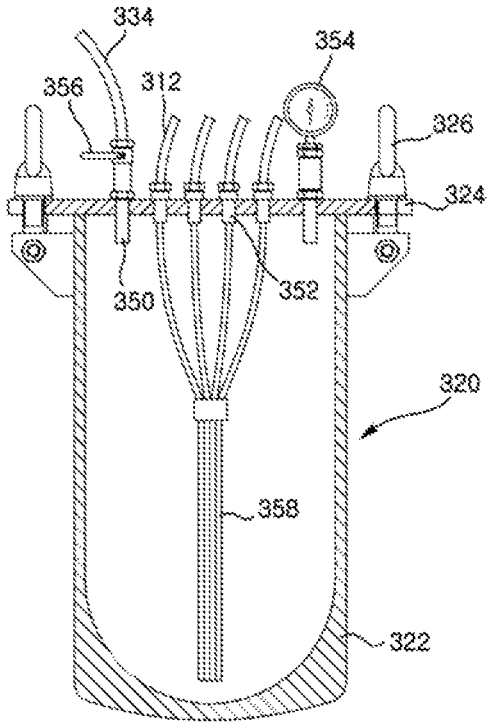
FIG. 9 is a cross-sectional view illustrating a storage tank according to an exemplary embodiment of the present disclosure.

Referring to FIG. 9, the solution storage tank (320) may include a tank body (322) taking the shape of a cylinder with an upper side being opened, and an air-tightly sealing cover (324) mounted to the opened upper side of the tank body (322) in an air-tightly sealing manner. A clamp device (326) may be interposed between the tank body (322) and the sealing cover (324) to allow the tank body (322) to be air-tightly mounted with the sealing cover (324).

Figure 10:
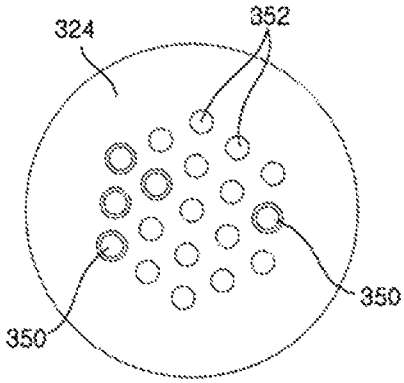
FIG. 10 is an upper view illustrating a storage tank according to an exemplary embodiment of the present disclosure.

Referring to FIG. 10, an air inflow pipe (350) for introducing the high temperature high pressure air into the tank body (322) and a solution supply pipe (352) individually connected to each spray gun (302) for supplying silver solution to each spray gun (302) are mounted through the sealing cover (324). The sealing cover (324) may be formed with a pressure gauge (354) for measuring an inner pressure of the storage tank (320). The air inflow pipe (350) may be mounted with an open/close valve (356) for opening and closing the air inflow pipe (350) for being connected to the air tank (330) via the air line (334).

A plurality of solution supply pipes (352) may be provided, each being connected to each spray gun (302) via the air line (312), where the solution supply pipe that is not connected to the solution line (312) is sealed using a bolt. The tank body (322) may be mounted therein with a plurality of inflow hoses (358) connected to the solution supply pipe (352). A distal end of the inflow hose (358) may be positioned at a place nearly touching a floor bed of the tank body (322), and the floor bed of the tank body (322) is concaved to allow the silver solution to be smoothly poured through the inflow hose (358).

The solution storage tank (320) is configured such that the silver solution stored in the storage tank (320) is supplied to each spray nozzle (302) via the silver solution supply pipe (352) by the pressure that is generated by the high pressure high temperature air via the air supply inflow pipe (350) into the tank body (322). The silver solution is heated to a predetermined constant temperature due to the air heated at a high temperature.

Furthermore, the solution storage tank (320) is individually and simultaneously connected to each spray gun (302) to allow the supply pressure of the silver solution supplied to the plural spray guns (302) to be maintained at a constant level.

That is, in a case the silver solution is distributed to each spray gun from the storage tank (320), there may be generated a pressure difference at each spray gun due in the course of distribution. However, each spray gun is connected to the silver solution storage tank on one-on-one base in the present exemplary embodiment, such that the pressure in the plurality of spray guns can be uniformly maintained.

The high pressure high temperature air supplied to the control box (370) is branched by a plurality of air lines (332) to be supplied to each spray gun (302*a*, 302*b* . . . 302*n*). The control box (370) designed to adjust a spray pressure of each spray gun (302*a*, 302*b* . . . 302*n*) may individually include a pressure gauge (372) showing pressure of each spray gun (302*a*, 302*b* . . . 302*n*), and a pressure adjustor (374) adjusting pressure of each spray gun (302*a*, 302*b* . . . 302*n*), such that pressure of each spray gun can be individually adjusted.

Figure 11:
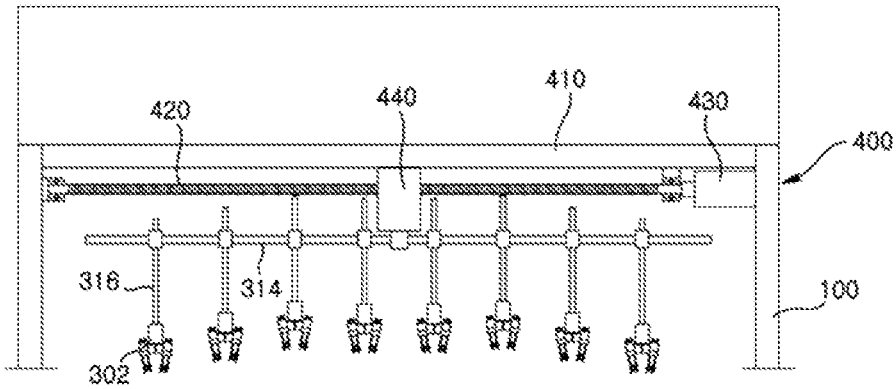
FIG. 11 is a lateral view illustrating a transfer device according to an exemplary embodiment of the present disclosure.
Figure 12:
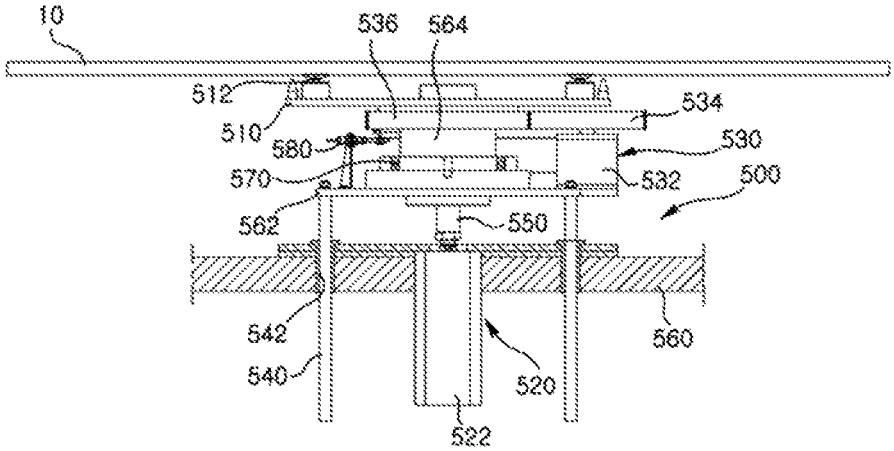
FIG. 12 is a lateral view illustrating a rotation device according to an exemplary embodiment of the present disclosure.

Referring to FIG. 11, the moving device (400) may include a frame (410) fixed at an upper surface of the treatment booth (100), lead screws (420) each rotatably supported at both sides of the frame (410), a motor connected to a distal end of the lead screw (420) to rotate the lead screw, and a moving rail (440) screwed to the lead screw (420) and fixed to a support bar (314) to linearly move along the lead screw (420) in a case the lead screw (420) is rotated. The moving device (400) may be applied with any structure as long as spray guns can be linearly reciprocated, in addition to the abovementioned structure.

The moving device (400) serves to evenly spray the silver solution to the surface of the substrate (10) by linearly reciprocating the spray guns (302).

A rotation device may include a suction plate (510) formed at a lower side of the treatment booth (100) for vacuum-sucking a substrate (10) transferred into the treatment booth (100) by the transfer device (200), a lift unit (520) formed at a lower side of the suction plate (510) for horizontally moving the suction plate (510) such that the substrate (10) can be separated from a transfer roller, and a rotation unit (530) for rotating the suction plate (510).

The suction plate (510) may be mounted with a plurality of suction units (512) sucked to a lower surface of the substrate (10) by vacuum pressure. The suction unit (512) may be sucked to the lower surface of the substrate in a case a vacuum pressure is applied via a vacuum line to supply the vacuum pressure, and may be released from the lower surface of the substrate in a case the vacuum pressure is removed.

The suction plate (510) may be interposed between the first and second transfer rollers (210, 220) so as to vertically move between first and second transfer rollers (210, 220).

The lift unit may include a driving cylinder (522) fixed at a frame (560), a support plate (562) fixed at an operation rod (524) of the driving cylinder (522), and a connection member (564) for connecting the support plate (562) and the suction plate (510).

At this time, the driving cylinder (522) may be a cylinder in which the operation rod (524) is linearly reciprocated by hydraulic pressure or air pressure, or may be a solenoid type cylinder in which the operation rod is linearly reciprocated in a case an electric power is applied.

The frame (560) may be fixed at the treatment booth (100), and a guide rod (540) may be interposed between the frame (560) and the support plate (562) to lift the support plate (562). That is, an upper distal end of the guide rod (540) is fixed at the periphery of the support plate (562), and the frame (560) is formed with a slide hole (542) in which the guide rod (540) moves, whereby the guide rod (540) is slidably moved.

A rotation unit (530) may include a driving motor (532) fixed at the support plate (562), a driving gear (534) fixed at a driving axis of the driving motor (532), and a driven gear (536) meshed with the driving gear (534) and fixed at a periphery of the connection member (564) fixed at a lower surface of the suction plate (536).

A bearing (570) supported by the connection member (564) that rotates and lifts may be interposed between the connection member (564) and the support plate (562). That is, the bearing (570) is circumferentially interposed between a bottom periphery of the connection member (564) and an upper inner surface of the support plate (562) to rotatably support the connection member (564) fixed underneath the suction plate (510). The connection member (564) may be formed at one side thereof with a rotation angle detection sensor (580) for detecting a rotation angle of the connection member (564).

The rotation speed of the substrate (10) for depositing the nano metallic silver solution on the surface of the substrate may depend on various conditions such as types of solution, temperature and humidity. However, it is preferable that the rotation speed be in the range of 20~80 rpm on the average.

Furthermore, the substrate is rotated in the forward and backward directions in response to a signal from the rotation angle detection sensor (580) in the repeated manner. The reason of rotating the substrate in the forward and backward directions in the repeated manner is to avoid hindrance to uniformity of thickness in the nano silver thin film that may be resultant from residual nano-sized metallic silver staying at one lopsided area on the substrate due to centrifugal force in one direction.

Now, operation of the rotation device thus configured will be described.

In a case the substrate (10) is transferred into the treatment booth (100) by the transfer rollers (210, 220), the driving cylinder (522) is activated to lift the operation rod (524) of the driving cylinder (522), and as a result, the support plate (562) is lifted to lift the suction plate (510) connected to the support plate (562) by the connection member (564) and to be separated from the transfer rollers (210, 220).

Under this state, in a case the driving motor (532) is activated, the driving gear (534) fixed to the driving axis of the driving motor (532) is driven to simultaneously drive the driven gear (536), and to rotate the suction plate (510).

At this time, the bearing is connected to the support plate (562) and the connection member (564) to cause the connection member (564) to rotate.

Now, operation of the silver thin-film spread apparatus by means of deposition of nano metallic silver thus configured according to the exemplary embodiment of the present disclosure will be described in detail.

First, a process of the silver solution being sprayed from the spray guns (302) will be explained.

The high pressure air stored in the air tank (330) passes the heating unit (360) to be changed to a high pressure high temperature air, which in turn passes the air lines (362, 334) to be supplied to the control box (370) and simultaneously supplied to the storage tank (320).

The high pressure high temperature air supplied to the control box (370) is manipulated by pressure adjustor (374) mounted at the control box (370) to adjust the pressure of air supplied to each spray gun (302), whereby the high temperature high pressure air can be adjusted and individually supplied to the spray gun (302) by the control box (320), such that the spray pressure can be differently set up according to the positions of the spray guns.

In a case the high temperature high pressure air is supplied to the solution storage tank (320), the silver solution stored in the solution storage tank (320) is heated and supplied with pressure to allow the silver solution to be individually supplied to each spray gun (302).

As noted above, because the solution storage tank (320) and the spray guns (302) are individually connected via the solution line (312), amount of solution supplied to the plurality of spray guns can be equally maintained to enhance the spraying performance.

Furthermore, the first door (130) mounted at the inlet (110) of the treatment booth (100) is opened to drive the transfer device (200), whereby the substrate (10) is entered into the treatment booth (100). Thereafter, the first door is shut off to stop movement of the transfer device (200).

As explained above, the silver thin film formation process is being performed inside the treatment booth (100) to prevent the nano-sized metallic silver solution sprayed into the treatment booth (100) from being discharged outside of treatment booth (100), whereby the atmospheric environmental pollution can be avoided to maintain a clear interior of a work place.

Then, the rotation device (400) and spray device (300) are driven to perform the silver thin film formation process on the surface of substrate (10).

To be more specific, as explained, the rotation device is driven to separate the substrate from the transfer rollers (210, 220) and to rotate the substrate (10) sucked to the suction plate (510).

At this time, in a case the substrate is repeatedly rotated in the forward and backward directions, the nano metallic silver particles are quickly spread on the surface of the substrate by the centrifugal force to allow the nano silver thin film to be uniformly spread and deposited on the surface of the substrate.

Now, the operation of the spray device (300) will be described. The surface of the substrate is sprayed with silver solution by the spray guns (302), whereby the spray guns (302) linearly reciprocate to spray the silver solution on the surface of the substrate according to operation of the transfer device (400).

As noted above, because the spray guns (302) linearly reciprocate, the thickness of the silver thin film can be uniformly maintained to cause a reflection plate to be manufactured with excellent film compactness and reflectivity.

In a case the silver thin film formation process is completed on the surface of the substrate, the rotation device is driven to place the substrate (10) on the transfer rollers (210, 220), whereby the transfer rollers (210, 220) are driven to open the second door (140) at the outlet (120), and the substrate (10) is progressed to next process.

The above-mentioned silver thin-film spread apparatus by means of deposition of nano metallic silver according to the present disclosure may, however, be embodied in many different forms and should not be construed as limited to the embodiments set forth herein. Thus, it is intended that embodiments of the present disclosure may cover the modifications and variations of this disclosure provided they come within the scope of the appended claims and their equivalents.

While particular features or aspects may have been disclosed with respect to several embodiments, such features or aspects may be selectively combined with one or more other features and/or aspects of other embodiments as may be desired.

What is claimed is:

1. A silver thin film spread apparatus by means of deposition of nano metallic silver, the apparatus comprising: it treatment booth formed at one side with an inlet for inputting a substrate, and formed at the other side with an outlet for discharging the substrate; a transfer device formed at a lower side of the treatment booth for transferring the substrate; a spray device formed at an upper side of the treatment booth for spraying silver solution on a surface of the substrate; a moving device for linearly reciprocating the spray device; and a rotation device formed at the lower side of the treatment booth for rotating the substrate; wherein the spray device includes a plurality of spray guns formed on an upper side of the treatment booth, each distanced apart at a predetermined space, a support horizontally formed on the upper side of the treatment booth, an adjusting rod connected at the support at a predetermined space, and mounted at a distal end with the plurality of spray guns, and a height adjustor formed between the support and the adjusting rod for adjusting the height of at least one of the plurality of spray guns.

2. The apparatus of claim 1. wherein a first door for air-tightly opening and closing the inlet is formed at the inlet of the treatment booth, and a second door air-tightly opening and closing the outlet is formed at the outlet of the treatment booth.

3. The apparatus of claim 1, further including a thermo-hygrostat and an air discharge device formed at the treatment booth for maintaining an interior of the treatment booth at a constant temperature state and at a constant humidity state.

4. The apparatus of claim 1, wherein the plurality of spray guns are formed with a two-headed spray gun having two nozzles, and the nozzle may have a diameter in the range of 0.5 mm~1 mm.

5. The apparatus of claim 1, wherein the moving device includes a housing fixed at an upper surface of the treatment booth, a lead screw rotatably supported at both skies of the housing, a motor connected to a distal end of the lead screw to rotate the lead screw, and a moving rail screwed to the lead screw and fixed to the support.

6. The apparatus of claim 1, wherein the rotation device includes a suction plate formed at a lower side of the treatment booth for vacuum-sucking a substrate transferred into the treatment booth by the transfer device, a lift unit formed at a lower side of the suction plate for horizontally moving the suction plate such that the substrate can be separated from a transfer roller, and a rotation unit for rotating the suction plate.

7. The apparatus of claim 6, wherein the lift unit includes a driving cylinder fixed at a frame, a support plate fixed at an operation rod of the driving cylinder, and a connection member for connecting the support plate and the suction plate.

8. The apparatus of claim 6, wherein the rotation unit includes a driving motor fixed at the support plate, a driving gear fixed at a driving axis of the driving motor, and a driven gear meshed with the driving gear and fixed at a periphery of the connection member fixed at a lower surface of the suction plate.

9. The apparatus of claim 1, further including an air/solution supply device for supplying high pressure air and silver solution to the spray gun.

10. The apparatus of claim 9, wherein the air/solution supply device includes an air tank for storing high pressure air, a heating unit connected to the air tank for heating the high pressure air discharged from the air tank to high pressure high temperature air, a solution storage tank connected to the heating unit for supplying the high pressure high temperature air, for storing the solution, heating, by the high pressure high temperature air, the silver solution to a predetermined temperature, and pumping the silver solution, a plurality of spray guns for being supplied with the solution stored in the solution storage tank and with the high pressure high temperature air that has passed the heating unit, and spraying the solution to the surface of the substrate, and a control box connected to the heating unit and to the plurality of spray guns for individually controlling pressure of air supplied to the plurality of spray guns.

11. The apparatus of claim 9, wherein the solution storage tank includes a tank body for storing the solution and a sealing cover air-tightly mounted at an upper surface of the tank body that is opened, wherein the sealing cover may include an air inlet pipe connected to the heating unit for supplying the high pressure high temperature air into the tank body, and a solution supply pipe individually connected to the plurality of spray guns via a solution line for supplying an equal amount of solution to the plurality of spray guns.

* * * * *